United States Patent [19]

Patin

[11] 4,043,855

[45] Aug. 23, 1977

[54] MULTI-LAYER ARTICLE AND A PROCESS AND AN APPARATUS FOR ITS MANUFACTURE

[75] Inventor: Claude Guy Patin, Pont-Audemer, France

[73] Assignee: Compagnie des Etablissements Dela Risle, Paris, France

[21] Appl. No.: 554,707

[22] Filed: Mar. 3, 1975

[30] Foreign Application Priority Data

| | | |
|---|---|---|
| Mar. 1, 1974 | France | 74.06985 |
| Feb. 12, 1975 | France | 75.04295 |

[51] Int. Cl.[2] ..... B31F 1/00

[52] U.S. Cl. ..... 156/178; 156/204; 156/227; 156/436; 156/443; 156/459

[58] Field of Search ..... 156/474, 226, 227, 173, 156/178–181, 176–177, 204, 436; 19/163; 28/1 CL; 186/443, 459

[56] References Cited

U.S. PATENT DOCUMENTS

| | | | |
|---|---|---|---|
| 1,658,860 | 2/1928 | Schorsch | 19/163 |
| 2,588,725 | 4/1952 | Hogan | 156/474 X |
| 2,785,728 | 3/1957 | Sluyter et al. | 19/163 |
| 2,927,350 | 3/1960 | Nelson | 19/163 |
| 2,962,772 | 12/1960 | Draving et al. | 19/163 |
| 3,222,730 | 12/1965 | Kalwaites | 19/163 |
| 3,682,755 | 8/1972 | Lee | 156/183 X |
| 3,740,282 | 6/1973 | Watson | 156/183 X |

*Primary Examiner*—David A. Simmons
*Attorney, Agent, or Firm*—Holman & Stern

[57] ABSTRACT

A multi-layer web or strip is produced from a single strip, by folding this single strip on itself, forming alternate loops in zig-zag form, the second portion of a loop partially covering the first portion of the same loop and being covered in the same proportion by the first portion of the following contiguous loop. The present invention is applicable to the continuous manufacture of multi-layer sheets for cleaning, hygiene or mechanical purposes.

8 Claims, 16 Drawing Figures

1b
1
2
3
4
5
6
6'
6"
7
7'
8
9
10
11
12
13
14
15
C

MULTI-LAYER ARTICLE AND A PROCESS AND AN APPARATUS FOR ITS MANUFACTURE

BACKGROUND OF THE INVENTION

The invention relates to the manufacture of multi-layer sheets and especially to a process for continuously manufacturing articles comprising at least two thicknesses of absorbent and pliable material, such as the thin paper known as cellulose cotton, united with one another by interposition of textile or similar filaments spaced a few millimeters apart and forming a crossed network in at least two clearly separate directions. The invention also relates to an apparatus for carrying out the process, and to an article made by the process.

The articles of this type have a good cohesion, as well as a good resistance to tearing and to piercing, and hence their use particularly for cleaning, hygiene or mechanical purposes.

DESCRIPTION OF PRIOR ART

Methods of manufacturing articles of the type initially referred to are already known, which consist in using networks of already gummed or woven filaments, or informing these networks at the same time as the operation of effecting the union with one another of the thicknesses of pliable material.

Another method which is already known is that described in U.S. Pat. No. 3,682,755, which consists in reinforcing filaments being fixed beforehand to one face of a pliable paper web, the said filaments being parallel and in the direction of the width. These filaments are coated with an adhesive, making them heat-weldable. At least one of these webs is unwound from a reel, so as to form a spiral tube with adjoining turns or even with slightly overlapping edges, the face comprising the filaments facing inwardly. This spiral is then flattened and passed between two heating presses, as a result of which the adhesive of the filaments causes the surfaces of the paper thus brought in contact to adhere to one another. The product thus obtained therefore has at least two thicknesses (three when the edges overlap). Before the hot pressing, it is possible to have disposed on each face of this product a web or strip which is also provided on the inside with filaments previously stuck on longitudinally with thermoplastic adhesive.

This method is very interesting, because it avoids the necessity of having to produce beforehand already stuck networks or to have to arrange filaments across or diagonally of the direction of unwinding of a web or strip, these being relatively slow methods, requiring complicated apparatus and particularly not very accurate when it is a question of providing spacings of the order of 4 mm between the filaments without them becoming intermixed. In actual fact, the filaments are only deposited lengthwise on the paper, so that there is obtained excellent precision and a good possibility of high speed.

It is to be noted that this method has some inconveniences, especially the necessity of carrying out two successive operations, which is fairly expensive as regards labour costs, and also the necessity of causing the rotation at great height and at one or preferably two unwinding positions of one or two heavy paper reels for forming the initial spiral or helix, this necessitating a very expensive machine.

BRIEF SUMMARY OF THE INVENTION

The present invention permits the aforesaid inconveniences to be overcome.

It has for its object a process for continuously manufacturing an article which comprises at least two thicknesses of pliable and thin material, obtained by folding a single continuous web or strip of the said material, characterised in that the said strip is folded regularly on itself in concertina-fashion, forming alternate loops in zig-zag formation, each second portion of one of the said loops partially covering the first associated portion of the same loop and being partially covered in the same proportion by the first portion of the following contiguous loop, in that the said loops are flattened and in that the said portions are fixed one upon the other while overlapping, so as to form a multi-layer web or strip.

According to one embodiment of the invention, the loops are formed alternately on either side of a general mean plane of the continuously supplied strip on means for supporting and continuously transferring the loops in an angular direction in relation to the direction of supply of the strip, the said angular direction being situated in the aforesaid mean plane.

The formation of the loops can advantageously be obtained by alternate displacement of the strip in at least one zone situated in the vicinity of the transfer means and in a direction substantially perpendicular to the general mean place of the supplied strip.

The angle between the direction of supply of the strip and the direction of transfer of the loops, the speed of supply of the strip and the speed of transfer of the loops, and also the amplitude of the alternate displacements of the strip in the vicinity of the transfer means are chosen as a function of the number of thicknesses which is desired.

According to another embodiment of the invention, loops are formed in a zone provided between the continuous supply means of the said strip and means for supporting and continuously transferring the said loops, the said strip being alternately applied in the said zone against the said supply means and on to the said supporting and transfer means, and the said strip being supplied in a plane substantially parallel to the transfer plane of the loops and in an angular direction relatively to the transfer direction.

The angle between the direction of supply of the strip and the direction of transfer of the loops, the speed of supply of the strip and the speed of transfer of the loops and also the length of strip applied before application to the transfer means are chosen as a function of the number of thicknesses which is desired.

In order to fix the loop portions being overlapped relatively to one another, adhesive means are applied to the strip, such as a series of heat-bonding filaments parallel to the edges of the strip and regularly spaced from one another, it being possible for the filaments on one face to be offset from the filaments on the other face. In this case, after forming the loops a reinforcement of crossed filaments is obtained. It is also possible to use filaments capable of contraction, so as to goffer the layers of material adjoining the filaments, by these latter being heated. It is also possible to apply a strip of pliable material to at least one face of the multi-layer strip.

The present invention also has for its object an apparatus for carrying into effect the process as described above.

The apparatus according to the invention comprises at least one means for supplying and guiding the continuous strip of pliable material, means for forming regular loops, means for supporting and transferring the said loops in an angular direction relatively to the supply direction, means for flattening the said loops, and means for fixing to one another the parts of the loop portions which are overlapping.

The present invention also has for its object an article comprising at least two thicknesses or pliable material, obtained by a process of the type described above.

BRIEF DESCRIPTION OF THE DRAWINGS

The invention will be best understood by reading the following detailed description and considering the accompanying drawings, which illustrate by way of example several embodiments of the invention.

In the drawings.

DESCRIPTION OF THE PREFERRED EMBODIMENTS

Figures 1A, 1B, 1C, 1D, 1E, 2A, 2B, 2C:
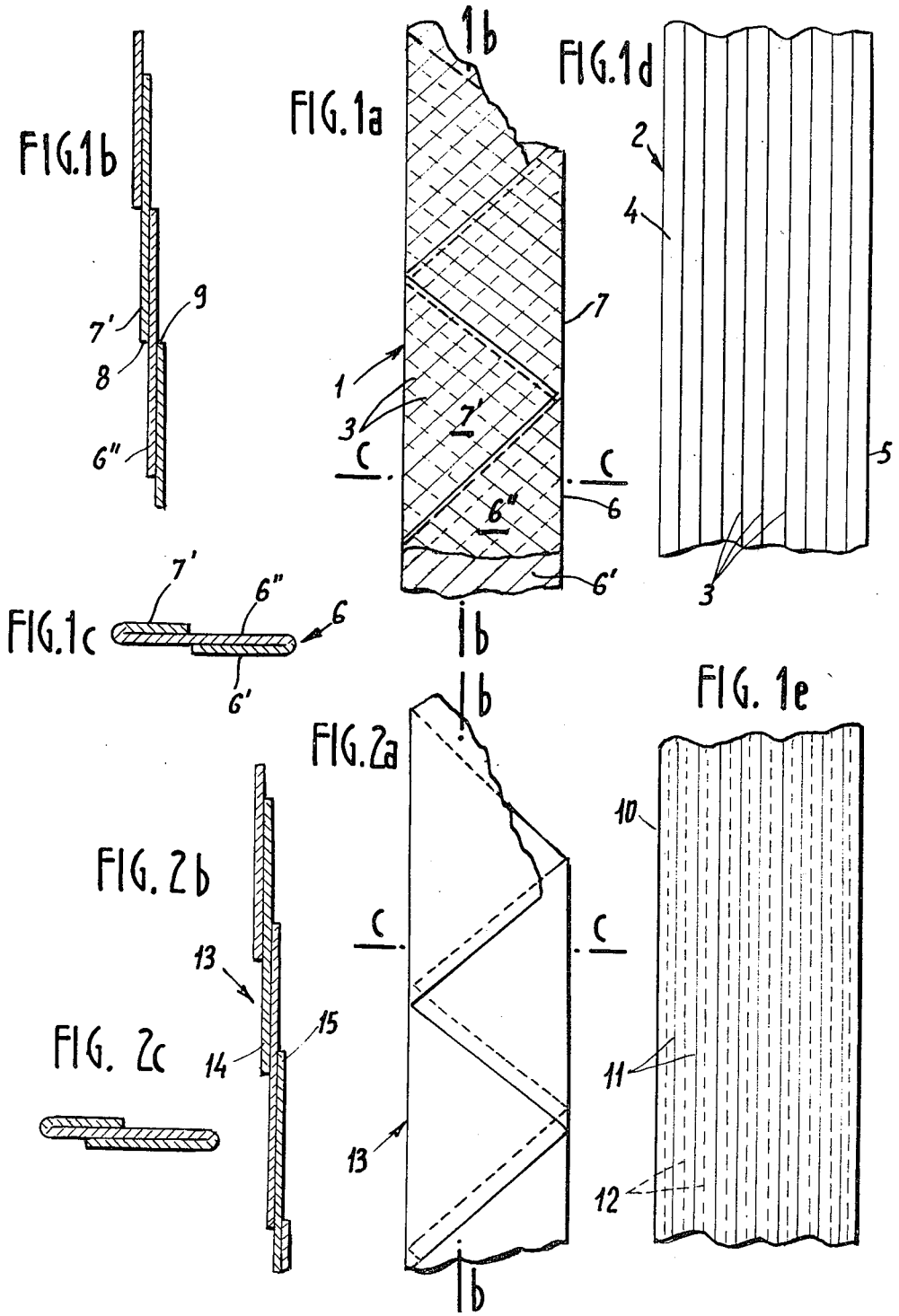
FIGS. 1*a*, 1*b*, and 1*c*, represent a multi-layer strip or web which is obtained by a process according to the invention, these Figures being respectively a plan view, a section on the line *b —b* and a section on the line *c —c* of FIG. 1*a*, obtained by folding the strip shown in FIG. 1*d*.
FIG. 1*e* represents a variant of the strip 1*d*.
FIGS. 2*a*, 2*b*, and 2*c* represent a multi-layer strip according to a variant of the invention, respectively as a plan view, a section on the line *b —b* and a section on the line *c —c* of FIG. 2*a*.

FIG. 1*a* shows as a top plan view a multi-layer strip 1 of a pliable and thin material, for example paper, obtained by folding a single strip 2 (FIG. 1*d*), both faces of which comprise adhesive means, such as a series of heat-bonding filaments 3 which are parallel to the edges 4,5 of the strip 2 and are regularly spaced from one another and coincide with one another on the two faces.

For obtaining the multi-layer strip 1 from the single strip 2, the latter is folded on itself regularly, concertina-fashion, thereby forming alternate loops in zig-zag formation, the second portion 6″ of one loop 6 partially covering the first portion 6′ of the same loop and being partially covered in the same proportion by the first portion 7′ of the following contiguous loop 7. In FIG. 1*a*, the heat-bonding filaments situated on a lower layer are represented by broken lines. The edges of two contiguous loops, such as the edges 8 and 9, substantially coincide on either side of the loop portion 6″. This method of folding thus makes it possible to obtain a strip wit two thicknesses of paper and a reinforcement of crossed heat-bonding filaments 3.

FIG. 1*e* shows a variant of the single strip 2. The strip 10 in FIG. 1*e* comprises a series of heat-bonding filaments on each face, the rows of filaments 11 on the upper face being offset relatively to the filaments 12 on the lower face, this permitting a better distribution of the resistance of the multi-layer sheet for an equal number of reinforcing filaments.

The multi-layer strip 13 of FIG. 2*a* is obtained by a folding procedure similar to that of the multi-layer strip 1 in FIG. 1*a*, but the sides or borders of the different loops, such as the borders 14 and 15, are staggered so as to form three thicknesses of paper in the junction zones of two successive contiguous loops.

Figure 3:
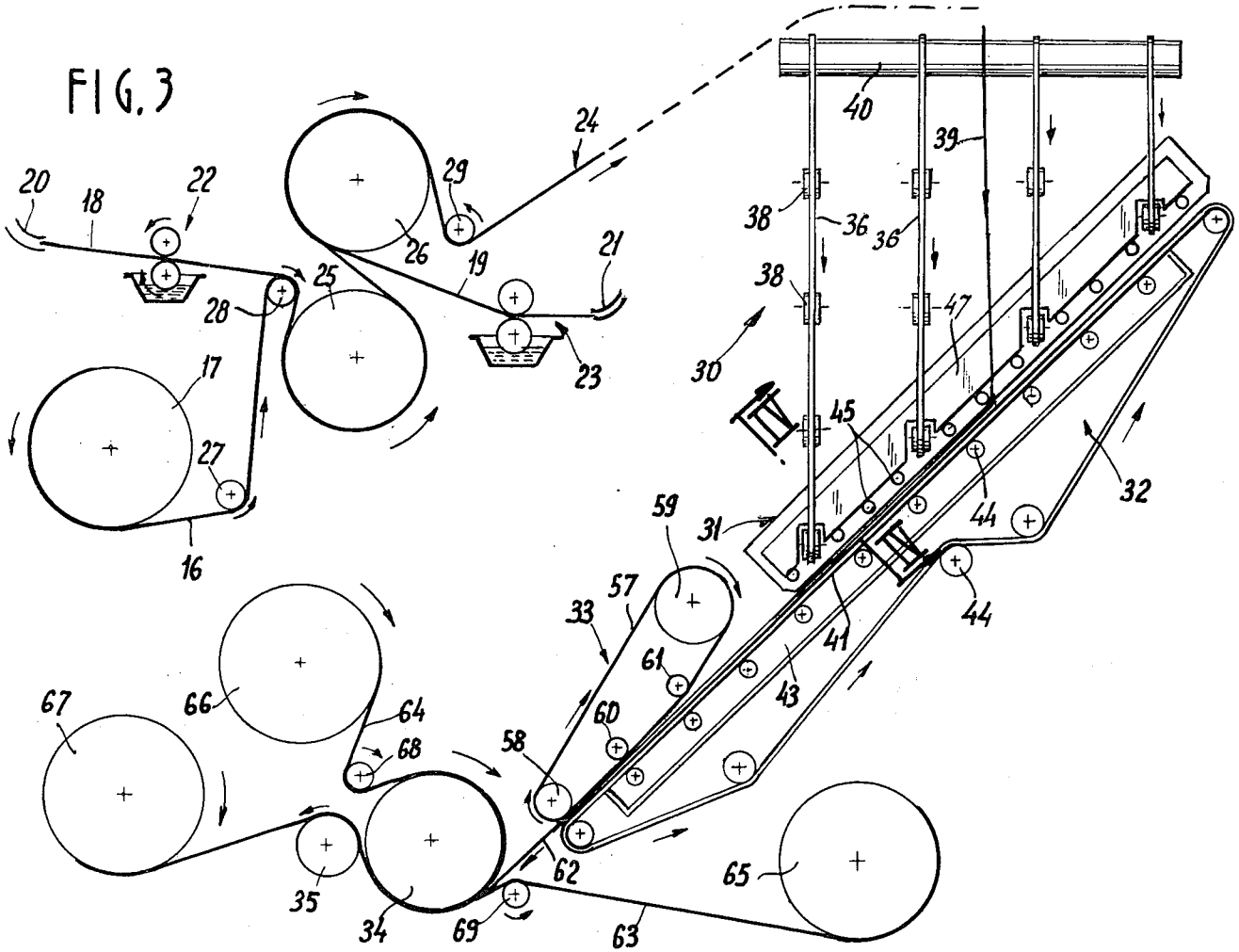
FIG. 3 shows diagrammatically an apparatus for the continuous manufacture of a multi-layer strip.

FIG. 3 illustrates an apparatus for the manufacture of a multi-layer strip of the type shown in FIGS. 1*a* and 2*a*. On to a single strip or web of paper 16 unwound from a reel 17 are stuck rows of filaments 18,19 coming from conduits 20,21, respectively, of supply devices (not shown). The filaments 18,19 are coated with adhesive at the adhesive applying positions 22, 23, respectively. It is preferred to use an adhesive in the form of an aqueous dispersion which sets by evaporation of its water but which becomes very soft and thermo-sealable when it is heated and becoming solid at ambient temperature (for example, a vinyl dispersion). The filaments 18 are applied to one face of the single strip or web 16 and the filaments 19 to the other face, either in coincidence or with offsetting, so as to obtain a single strip 24 which is respectively of the type shown in FIG. 1*d*, or of the type shown in FIG. 1*e*. The references 25,26 represent heated drying cylinders, which are covered with a non-adhesive substance, such as polytetrafluoethylene. As a result, the filaments adhere to the paper and not to the cylinder. The references 27,28,29 indicate guide rollers. The appropriate driving means (not shown) is of conventional type. The apparatus also comprises means 30 for supplying and guiding the strip 24, bringing the latter to loop-forming means 31, means 32 for supporting and transferring the loops, means 33 for flattening the loops and means 34,35 for fixing to one another those parts of loop portions which are overlapping. The means for supplying and guiding the strip comprise two opposed sets of parallel belts 36,37 (see FIGS. 3 and 4); in FIG. 3, the supply and guiding means 30 are represented as a section along the line III—III of FIG. 4). The belts 36,37, guided and driven by pulleys 38, grip between them the single strip represented in FIG. 3 by the arrow 39, which is thus guided and driven. At the upper end, the belts 36 and 37 pass over two rollers, of which only one (40) can be seen in FIG. 3. The transfer between the rollers 29 and 40, which are in fact parallel, is indicated diagrammatically in FIG. 3 by a broken line.

The means 32 for supporting and continuously transferring the loops comprise a conveyor band 41 in which is formed a plurality of holes 42, which are in communication with a suction chamber 43, in the zone where the band 41 is supporting the loops. The band 41 is guided and driven by a plurality of rollers 44.

As can be seen from FIG. 3, the direction of transfer of the loops on to the band 41 and the direction of supply of the strip or web 39 form an angle of about 45°, the transfer direction being situated in the general mean plane of the supplied strip or web.

The loop-forming means 31 comprise two sets of compressed air nozzles 45 and 46, acting alternately in opposite directions and substantially perpendicular to the plane of the supplied web, means for limiting the size of the loops being formed on the band 41 and means for holding at least one formed loop while the following loop is being formed. The means for limiting the size of the loops comprise sheet metal deflectors 47,48 disposed above the conveyor band 41 and the lower part 49,50 of the nozzles 45,46. The means for holding a formed loop while the following loop is being formed are constituted by the nozzles 45,46 which, by pivoting about pivot shafts 51,52, respectively, are adapted to be applied alternately to the formed loops without preventing the transfer thereof. The pivoting of the nozzles 45 and 46 is controlled by lever arms 53,54, respectively.

Figure 4:
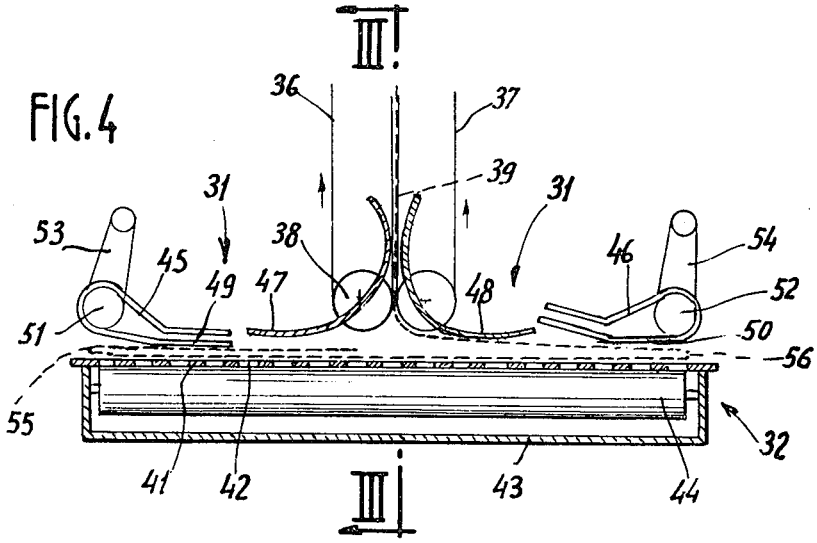
FIG. 4 shows diagrammatically a section on the line IV—IV of FIG. 3.

The manner in which the apparatus functions is as follows:

The web or strip 39 is supplied continuously along a general mean plane corresponding to the sectional plane III—III of FIG. 4, and the loops 55,56 are formed alternately on either side of this plane, on the conveyor band 41, by alternate displacement of the strip 39 in the vicinity of the band 41, and in a direction substantially perpendicular to the aforesaid plane. The conveyor band 41 is displaced at a speed equal to $\sqrt{2}/2$ of the speed of the belts 36,37.

In FIG. 4, a loop 55 has just been formed, and it is held by the nozzles 45 beneath which it slides, driven by the hand 41. Under the action of the compressed air from the nozzles 45, the single band 39, when it leaves the gripping action of the belts 36,37 is pushed towards the right in FIG. 4. A loop 56 is formed between the zone of application of the nozzles 45 and the supplied strip 39. This loop 36 is inflated and extended by the action of the compressed air, but it is limited as regards thickness by the hand 41, the deflector 48 and the lower part of the nozzles 46 in a raised position. As soon as the loop 56 is formed, the nozzles 46 are applied to the said loop, the nozzles 45 being raised and a loop being formed on the left in FIG. 4, under the action of the compressed air coming from the nozzles 46.

By this cycle being repeated indefinitely, the single strip or web 39 is folded, concertina-fashion, forming alternate loops in zig-zag formation.

The alternate displacement of the single strip 39 on leaving the belts 36,37 changes in direction as soon as the conveyor band 41 has covered a distance equal to the width of the strip 39, divided by $\sqrt{2}$.

The pivoting of the nozzles 45,46 is controlled by any mechanism of conventional type (not shown), and it is to be noted that, in the raised position of the nozzles, the compressed air is sent in a direction in which it does not act on the paper web or strip.

During their transfer on to the conveyor band 41, the loops are suitably held by the suction exerted on their bottom face by the suction chamber 43.

The means 33 for flattening the formed loops comprise a flat belt 57 which is guided and driven by the pulleys 58,59,60,61 and which flattens the loops on the conveyor band 41.

On leaving the supporting and transfer means 32, the composite strip 62, with a structure of the type of the strip 1 shown in FIG. 1*a*, is sandwiched between the single strips 63,64 coming from reels 65,66, respectively, and it is pressed between the heated cylinders 34,35, which produce the bonding of the assembly by means of the filaments 18 and 19, and then the strip which is obtained is wound on to the take-up roller 67. The references 68,69 indicate guide cylinders.

In order to obtain a goffering of the different layers, it is possible to use filaments 18,19 which contract under heat.

Figure 6:
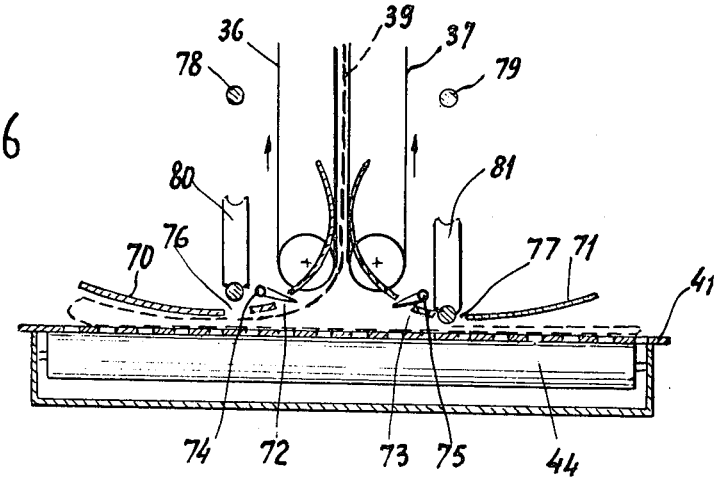
FIG. 6 shows diagrammatically a section on the line VI—VI of FIG. 5.
Figure 5:
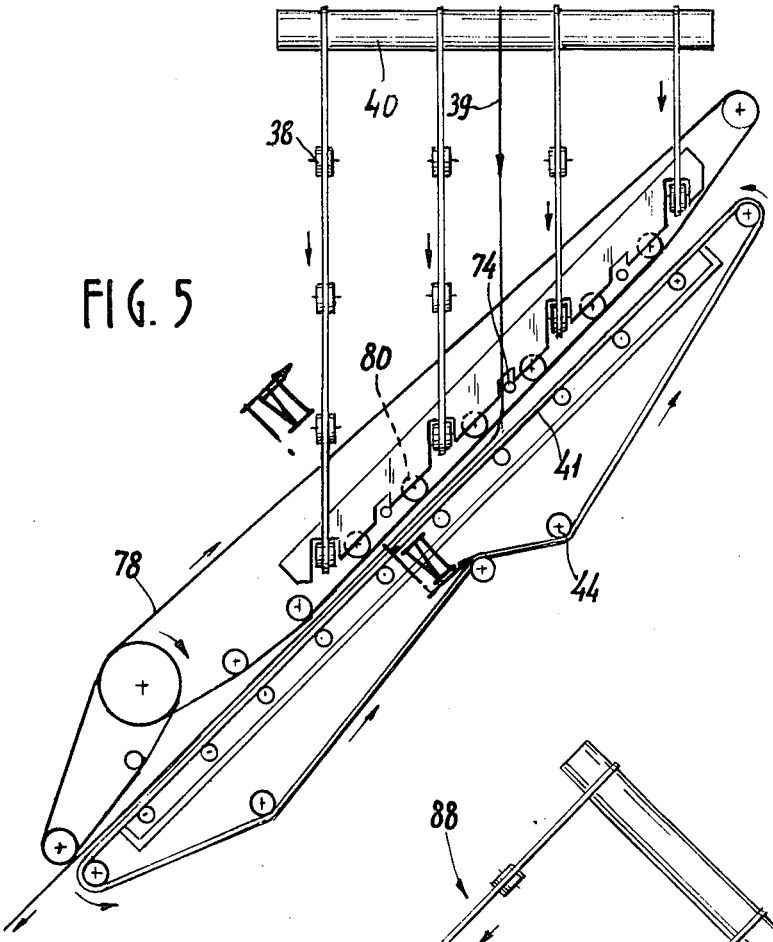
FIG. 5 shows diagrammatically a variant of a part of the apparatus for manufacturing the multi-layer strip.

In the arrangement which is shown in FIGS. 5 and 6, the means for limiting the size of the loops are formed by sheet metal deflectors 70,71 which comprise passages 72,73 for alternately functioning fixed nozzles 74,75, and passages 76,77 for belts 78,79 and pulleys 80,81. The belts 78,79 are displaced at the same speed as the conveyor band 41, they are situated on either side of the plane of the supplied strip or web and they can be applied alternately to the formed loops for holding them, by means of any mechanism of conventional type (not shown). In this embodiment, the nozzles are alternately supplied with compressed air.

Figure 8:
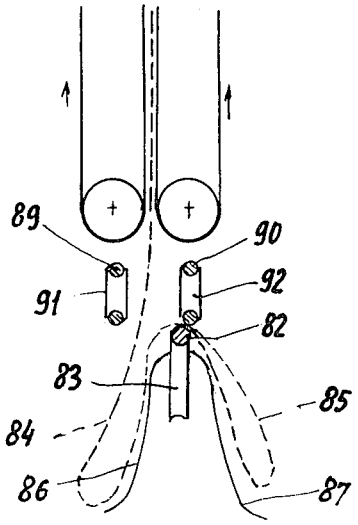
FIG. 8 shows diagrammatically a section on the line VIII—VIII of FIG. 7.
Figure 7:
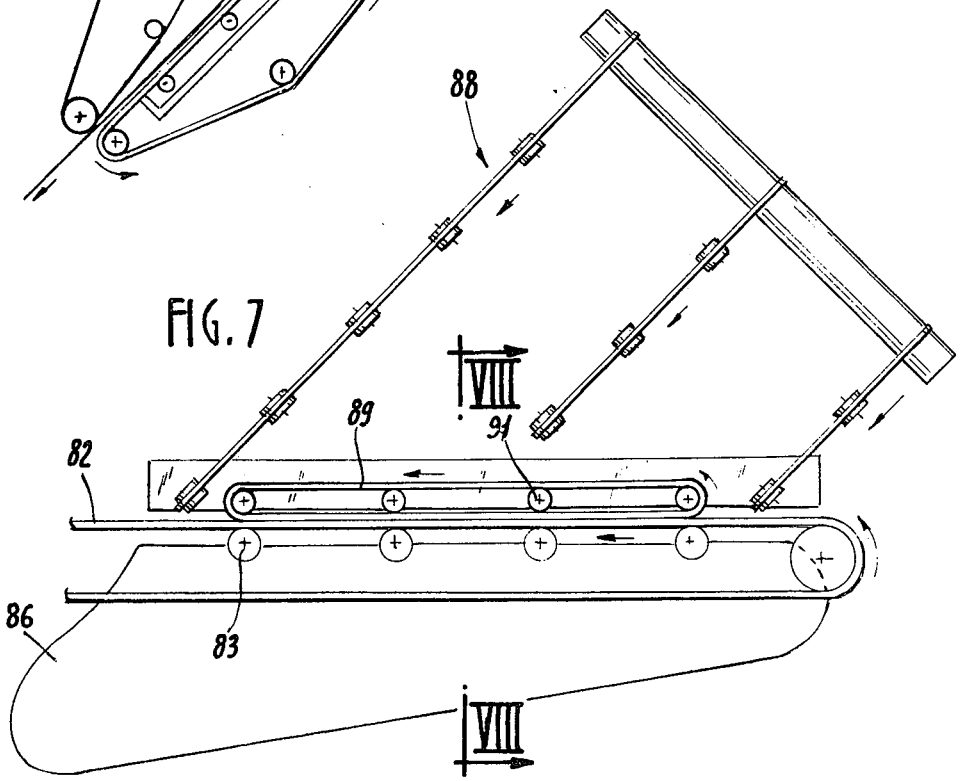
FIG. 7 shows diagrammatically another variant of a part of the apparatus for manufacturing the multi-layer strip.

In the arrangement which is shown in FIGS. 7 and 8, the means for supporting and transferring loops comprise a conveyor belt 82 which is guided and driven by rollers 83 and means for supporting and guiding loops 84,85 situated on either side of the belt 82 and formed by sheet metal deflectors 86,87, by which the loops are brought from a substantially vertical plane to a substantially horizontal plane, progressively in the direction of transfer. It is to be noted that, in this embodiment, the supply means 88 for the single strip are inclined by 45° relatively to the vertical, while the transfer belt 82 is horizontal. The loop-forming means comprise two lateral belts 89,90 located on either side of the mean plane of the supplied strip, the belts being guided and driven by pulleys 91,92 and being displaced at the same speed as the belt 82. The belts 89,90 and also the supply means 88 are given an alternating movement in a direction substantially perpendicular to the mean plane of the supplied strip or web, so as to form loops alternately on either side of the belt 82, the belts 89,90 being applied alternately to the formed loops so as to hold them.

When the angle of the direction of supply for the single strip and the angle as regards the transfer direction of the loops are exactly equal to 45°, the multi-layer strip which is obtained is of the type as shown in FIG 1*a;* with a slightly smaller angle, a multi-layer strip of the type shown in FIG. 2*a* is obtained, and with larger variations in the angle, it is possible to obtain any desired number of layers, the times of the cycles being modified as a consequence.

Figure 9:
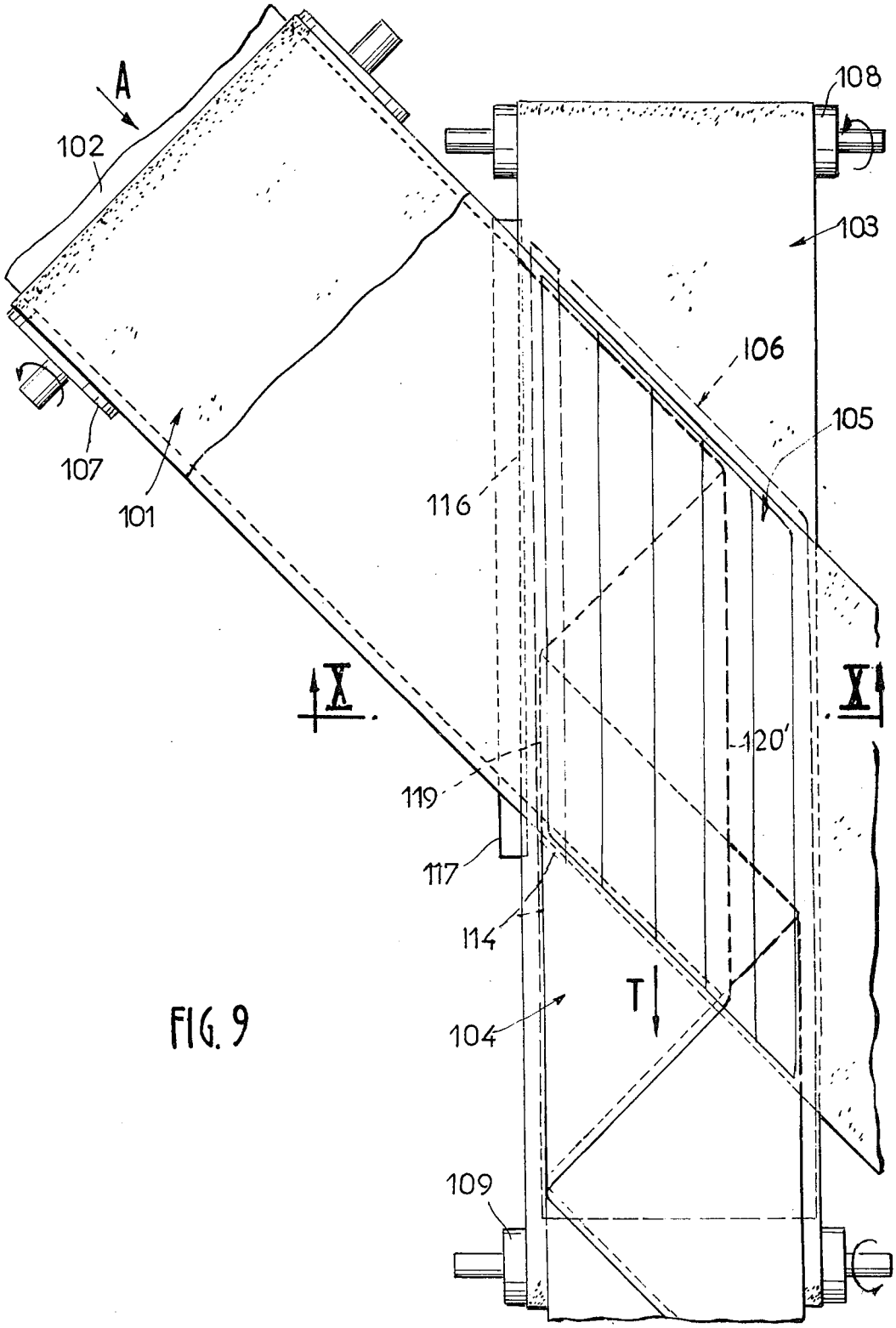
FIG. 9 shows diagrammatically a top plan view of another variant of a part of the apparatus according to the invention.
Figure 10:
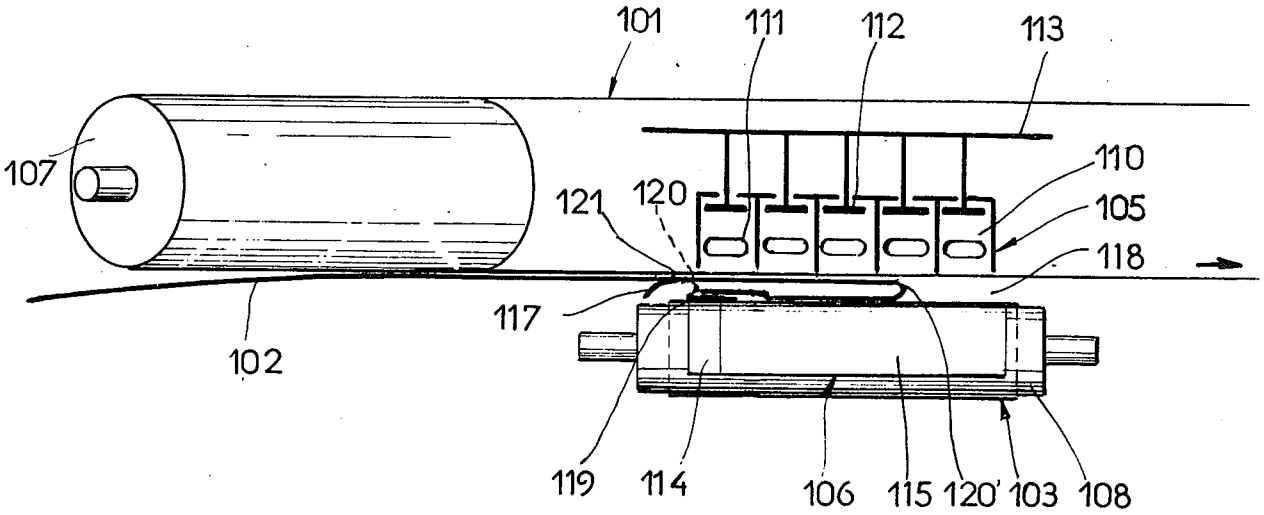
FIG. 10 shows diagrammatically a section on the line X—X of FIG. 9.

The arrangement which is shown in FIGS. 9 and 10 comprises a porous supply belt 101 for a continuous strip of pliable and thin material 102, a porous band 103 for supporting and transferring the formed loops 104, and upper suction means 105 and lower suction means 106. The strip 102 is supplied in a plane substantially parallel to the transfer plane of the loops 104, the supply direction (A) and transfer direction (T) forming between them an angle of about 45°. The references 107 and 108 indicate driving rollers, respectively for the belt 101 and the conveyor band 103. The reference 109 indicates a return roller for the band 103.

The upper suction means 105 act on a part of the belt 101 passing above the band 103 and comprise a plurality of suction chambers 110 connected to a vacuum source (not shown) by way of orifices 111. In each chamber 110, a piston 112 can be moved for cutting off the suction of the orifice 111 and supplying air from the chamber through the belt 102. The pistons 112 are connected to a plate 113.

The lower suction means 106 comprise two suction chambers 114 and 115. The chamber 114, or the chamber upstream relatively to the direction of supply (A) of the strip is operative on a relatively narrow zone in the vicinity of the upstream edge 116 of the conveyor band 103 and over a length corresponding substantially to the length of the portion of the band 103 passing beneath the belt 101. The suction chamber 115, or downstream chamber, contiguous with the chamber 114, acts substantially on the remainder of the width of the band 103 and is extended in the loop-transferring direction (T), to close to the return roller 109. The upstream chamber 114 is subject to a higher vacuum than the downstream chamber 115. A guide blade 117 for the supplied strip 102 and for the air which is drawn in is situated close to the upstream edge 116 of the transfer band 103.

The operation of the arrangement is as follows:

The strip of material 102 is driven by the porous belt 101 and is applied alternately to this belt and to the transfer band 103 in the zone where the belt 101 passes above the band 103.

When the band 102 driven by the porous belt 101, to which it is applied by the flexible strip 117 and by the suction of the chambers 110, reaches the point 118, it is applied to the conveyor band 103 by the action of the pistons 112: the pistons 112, driven by the plate 113, quickly drop into the suction chambers 110, they shut off the suction through the orifices 111 and compress the air still contained in the chambers 110. That portion of the strip 102 which is between the strip 117 and the point 118 is then immediately detached from the porous belt 101, so as to be applied to the conveyor band 103, to which it adheres under the action of the suction of the chambers 114 and 115. As the suction is particularly strong in the chamber 114, a fold 119 is formed and a moving or rolling return loop 120 (represented in broken lines in FIG. 2) is formed in the vicinity of the upstream edge of the band 103. The plate 113 then ascends again and the pistons 112 free from the suction orifices 111, and this permits the portion 121 of the band 102 situated between the strip or blade 117 and the rolling return portion to remain applied to the belt 101. The rolling return portion 120 is displaced towards the point 118. An intermediate position of this return portion is shown at 120' in FIGS. 9 and 10. When the rolling portion 120 reaches the point 118, that strip portion 102 which is between the blade 117 and the point 118 is applied to the conveyor band 103 by the action of the pistons 112. By repeating the same operational phases, a multi-layer sheet 104 is obtained. After passing over the roller 109, the formed loops can be transferred to other shaping positions.

The porosity of the belt 101 and of the conveyor band 103 is such that, for the reduced pressures which are obtaining in the chambers 110 and 115, the rate of flow of air per unit of surface is of the same value through, on the one hand, one strip layer 102 and the belt 101 and, on the other hand, through two strip layers 102 and the conveyor band 103. It will also be noted that a part of the air is withdrawn laterally beneath the blade 117, this facilitating the formation of the rolling return fold 120.

When the angle between the supply direction A and the transfer direction T is 45°, the conveying band 103 is displaced at a speed equal to $\sqrt{2/2}$ of the speed of the belt 101. The operation of the pistons 112 is under the control of the advance of the belt 101 or the band 103, using any suitable conventional mechanism (not shown). The strip 102 is applied to the band 103 when the supplied length of strip reaches the length of one loop, that is to say, twice the width of the strip 102, when it is desired to obtain a two-layer strip.

By way of example, it may be pointed out that good results are obtained with a paper strip (cellulose cotton) with a width of 2.40 meters and having a weight of about 15 g/m². In this case, the suction is about 25 g/km², while the interval between the belt 101 and the conveyor band 103 is in the region of 1 to 5 cm.

It is obvious that the invention is not limited to the embodiments which have been described and illustrated and that it is capable of undergoing numerous variations available to the person skilled in the art, depending on the proposed applications and without thereby departing from the scope of the invention.

I clam:

1. A process for continuously manufacturing an article which comprises at least two thicknesses of pliable and thin material, effected by folding a single continuous strip or web of the said material, wherein the said strip or web is folded on itself regularly, concertina-fashion, thereby forming alternate loops in zig-zag formation, each second portion of one of the said loops partially covering the first associated portion of the same loop and being partially covered in the same proportion by the first portion of the following contiguous loop, the said loops being flattened, and the said portions being fixed one upon the other while overlapping so as to form a multi-layer strip or web, each face of the said strip having applied thereto before the loops are formed a series of heat-bonding filaments, parallel to the edges of the said strip, and with a regular spacing from one another, the filaments on one face being able to be offset relatively to the filaments of the other face.

2. A process according to claim 1, wherein a reinforcement of crossed filaments is obtained after the loops have been formed.

3. A process according to claim 1, wherein said filaments are capable of contracting.

4. A process according to claim 3 wherein the layers of material adjacent said filaments are goffered by heating said filaments.

5. Apparatus for continuously manufacturing an article comprising at least two thicknesses of pliable and thin material, by folding a single continuous strip or web of said material, said apparatus comprising means for the supply and guiding of said continuous strip, means for forming alternate loops in zig-zag formation by folding said strip on itself, regularly in concertina-fashion, means for supporting and transferring said loops in an angular direction relative to the direction of supply of said strip, means for flattening said loops, and means for fixing to one another overlapping portions of said loops, wherein the loopforming means comprises at least two compressed air nozzles which act alternately in opposite directions and substantially perpendicular to the plane of the supplied strip, means for limiting the size of the loops and means for holding at least one formed loop during the formation of the following loop, the means for limiting the size of the loops comprising deflectors which are disposed above the conveyor band and the lower portion of said nozzles, and the holding means comprising said nozzles, adapted to be applied alternately to the formed loops.

6. Apparatus for continuously manufacturing an article comprising at least two thicknesses of pliable and thin material, by folding a single continuous strip or web of said material, said apparatus comprising means for the supply and guiding of said continuous strip, means for forming alternate loops in zig-zag formation by folding said strip on itself, regularly in concertina-fashion, means for supporting and transferring said loops in an angular direction relative to the direction of supply of said strip, means for flattening said loops, and means for fixing to one another overlapping portions of said loops, wherein the loopforming means comprises at least two compressed air nozzles which act alternately in opposite directions and substantially perpendicular to the plane of the supplied strip, means for limiting the size of the loops and means for holding at least one formed loop during the formation of the following loop, the means for limiting the size of the loops being formed by deflectors which are disposed above the conveyor band, and said holding means comprising two belts which are displaced at the same speed and in the same direction as the conveyor band, disposed on either side of the plane of the supplied strip and adapted to be applied alternately to the formed loops.

7. Apparatus for continuously manufacturing an article comprising at least two thicknesses of pliable and thin material, by folding a single continuous strip or web of said material, said apparatus comprising means for the supply and guiding of said continuous strip, means for forming alternate loops in zig-zag formation by folding said strip on itself, regularly in concertina-fashion, means for supporting and transferring said loops in an angular direction relative to the direction of supply of said strip, means for flattening said loops, and means for fixing to one another overlapping portions of said loops, wherein the means for supporting and transferring the loops comprises a conveying belt, and means for supporting and guiding said loops, disposed on each side of said conveying belt, and progressively bringing in the transfer direction said loops from a substantially vertical plane into a substantially horizontal plane.

8. Apparatus according to claim 7, wherein the loop-forming means comprises two lateral belts disposed on either side of the mean plane of the supplied strip, said lateral belts being displaced in the same direction and at the same speed as the conveying belt, and thus being given, like the supply and guiding means of the strip, an alternate movement in a direction substantially perpendicular to said mean plane of the supplied strip, said lateral belts being applied alternately to the formed loops.

* * * * *